US008974034B2

(12) United States Patent
Kawagoe

(10) Patent No.: US 8,974,034 B2
(45) Date of Patent: Mar. 10, 2015

(54) INK-JET RECORDING APPARATUS AND METHOD OF DETECTING INCLINATION OF NOZZLE ROW OF INK-JET HEAD

(75) Inventor: Masako Kawagoe, Nagoya (JP)

(73) Assignee: Brother Kogyo Kabushiki Kaisha, Nagoya-Shi, Aichi-Ken (JP)

( * ) Notice: Subject to any disclaimer, the term of this patent is extended or adjusted under 35 U.S.C. 154(b) by 285 days.

(21) Appl. No.: 13/363,175

(22) Filed: Jan. 31, 2012

(65) Prior Publication Data

US 2012/0249643 A1 Oct. 4, 2012

(30) Foreign Application Priority Data

Mar. 31, 2011 (JP) ..... 2011-078851

(51) Int. Cl.

| | |
|---|---|
| ***B41J 29/393*** | (2006.01) |
| ***B41J 29/38*** | (2006.01) |
| ***B41J 2/21*** | (2006.01) |
| ***B41J 25/00*** | (2006.01) |

(52) U.S. Cl.

CPC ..... *B41J 29/38* (2013.01); *B41J 2/2135* (2013.01); *B41J 25/003* (2013.01)

USPC ..... 347/19

(58) Field of Classification Search

CPC ..... B41J 2/2135

USPC ..... 347/19

See application file for complete search history.

(56) References Cited

U.S. PATENT DOCUMENTS 7,014,289 B1 * 3/2006 Matsuda ..... 347/19

FOREIGN PATENT DOCUMENTS

| | | | |
|---|---|---|---|
| JP | 2004-188680 | A | 7/2004 |
| JP | 2005-132066 | A | 5/2005 |
| JP | 2007-326315 | A | 12/2007 |
| JP | 2009-039958 | A | 2/2009 |
| JP | 2009-233962 | A | 10/2009 |

OTHER PUBLICATIONS

Japan Patent Office, Notification of Reasons for Refusal for Japanese Patent Application No. 2011-078851, mailed Apr. 23, 2013.

* cited by examiner

*Primary Examiner* — Manish S Shah
*Assistant Examiner* — Jeffrey C Morgan
(74) *Attorney, Agent, or Firm* — Merchant & Gould PC

(57) ABSTRACT

An ink-jet recording apparatus, including: a head having nozzles arranged in at least one row along an arrangement direction; a conveyor mechanism; and a controller including a pattern forming portion to form a pattern for detecting inclination of the at least one nozzle row with respect to the nozzle arrangement direction, the pattern including (A) a first inclination detect pattern including parallel two lines formed by ejection respectively from: a first nozzle group located at a first section of one of the at least one nozzle low and a second nozzle group located at a second section different from the first section, when the head moves in one direction in a scanning direction, and (B) a second inclination detect pattern including parallel two lines formed by ejection respectively from: the first nozzle group; and the second nozzle group, when the head moves in another direction opposite to the one direction.

9 Claims, 10 Drawing Sheets

INK-JET RECORDING APPARATUS AND METHOD OF DETECTING INCLINATION OF NOZZLE ROW OF INK-JET HEAD

CROSS REFERENCE TO RELATED APPLICATION

The present application claims priority from Japanese Patent Application No. 2011-078851, which was filed on Mar. 31, 2011, the disclosure of which is herein incorporated by reference in its entirety.

BACKGROUND OF THE INVENTION

1. Field of the Invention

The present invention relates to an ink-jet recording apparatus configured to record an image and the like on a recording medium.

2. Discussion of Related Art

There has been conventionally known the so-called serial-type ink-jet recording apparatus which has an ink-jet head with a plurality of nozzles arranged in one direction and which is configured to record an image and the like on a recording medium by ejecting ink droplets from the nozzles while the ink-jet head is moved in a direction (a scanning direction) intersecting the nozzle arrangement direction.

In the known ink-jet recording apparatus described above, there may be some cases wherein the ink-jet head is attached in a posture in which the ink-jet head is inclined or rotated relative to a normal posture in a plane that is parallel to a nozzle-arranged surface (a droplet ejecting surface) in which a plurality of nozzles are formed and which is to be opposed to a recording medium, due to assembling errors or the like. In such cases, rows of the nozzles are inclined relative to a normal nozzle arrangement direction, and rows of dots formed by the nozzle rows on the recording medium are also inclined, undesirably degrading the image quality. To deal with this, it is needed to first detect inclination of the ink-jet head (inclination of the nozzle rows) and to subsequently take some measures such as adjusting the posture of the ink-jet head such that the nozzle rows extend along the normal nozzle arrangement direction or adjusting ejection timings of the nozzles in accordance with the inclination of the nozzle rows.

There has been known a technique relating to detection of the inclination of the ink-jet head. In the technique, a dot row is initially formed on the recording medium by ejecting ink from three nozzles (one nozzle group) among a plurality of nozzles in one nozzle row while the ink-jet head is moved in one of opposite two directions in the scanning direction. The three nozzles (the one nozzle group) are located at the upstream portion of the one nozzle row in the conveyance direction. Subsequently, after the recording medium has been conveyed by a prescribed amount, another dot row is formed so as to be located adjacent to the dot row previously formed by the upstream-side nozzle group by ejecting the ink from another three nozzles (another nozzle group) among the plurality of nozzles in the one nozzle row while the ink-jet head is moved in the same direction as described above. The above-indicated another three nozzles (another nozzle group) are located at the downstream portion of the one nozzle row in the conveyance direction.

Here, where the nozzle row is inclined relative to the normal direction, there occurs a position shift in the scanning direction in accordance with the inclination of the nozzle row, between the dot row formed by the upstream-side nozzle group and the dot row formed by the downstream-side nozzle group. In view of this, in the above known technique, there is detected a distance (position shift) in the scanning direction between the dot row formed by the upstream-side nozzle group and the dot row formed by the downstream-side nozzle group. On the basis of the detected distance, the ejection timing of each of the nozzles of the nozzle row is adjusted, thereby eliminating the influence of the inclination of the nozzle row on the image quality.

SUMMARY OF THE INVENTION

In the above technique, the ejection timing of each nozzle is adjusted in accordance with the amount of the position shift, on the assumption that the position shift in the scanning direction of the two dot rows respectively formed by the upstream-side nozzle group and the downstream-side nozzle group arises entirely from the inclination of the nozzle row. The position shift of the two dot rows, however, may be caused by factors other than the inclination of the nozzle row.

More specifically, there may be a case in which the droplet ejecting surface of the ink-jet head and the recording medium are not parallel to each other, and accordingly a distance (gap) between the upstream-side nozzle group and the recording medium differs from that between the downstream-side nozzle group and the recording medium, when the two dot rows are formed. In such a case, there is caused a difference in a droplet flight time from ejection of the droplets from the nozzles to attachment to the recording medium, between the upstream-side nozzle group and the downstream-side nozzle group. As a result, there occurs an attachment-position shift due to the difference in the droplet flight time.

That is, the position shift in the scanning direction of the two dot rows respectively formed by the upstream-side nozzle group and the downstream-side nozzle group contains a component due to the gap difference between the upstream-side nozzle group and the downstream-side nozzle group. It is accordingly impossible to accurately detect the inclination of the nozzle row on the basis of the amount of the position shift described above.

It is therefore a first object of the invention to provide an ink-jet recording apparatus in which a position-shift component due to inclination of a nozzle row of an ink-jet head is extracted on the basis of a positional relationship between two lines (dot rows) respectively formed by two nozzle group in one nozzle row, so as to accurately detect the inclination. It is a second object to provide a method of accurately detecting the inclination of the nozzle row.

To attain the first object indicated above, an ink-jet recording apparatus according to the present invention is configured such that two lines are formed on a recording medium respectively by a first nozzle group and a second nozzle group in one nozzle row while an ink-jet head is moved in one of opposite two directions in a scanning direction and such that two lines are formed on the recording medium by the recording medium respectively by the first nozzle group and the second nozzle group while the ink-jet head is moved in the other of the opposite two directions in the scanning direction. To attain the second object indicated above, a method of detecting inclination of a nozzle row of an ink-jet head according to the present invention includes: a step of forming, on a recording medium, two lines respectively by a first nozzle group and a second nozzle group in one nozzle row while an ink-jet head is moved in one of opposite two directions in a scanning direction and two lines respectively by the first nozzle group and the second nozzle group while the ink-jet head is moved in the other of the opposite two directions in the scanning direction; and an inclination detecting step including obtaining distances between the two lines in the scanning direction and detecting inclination of the nozzle row on the basis of a sum of the distances.

FORMS OF INVENTION

There will be explained various forms of an invention which is considered claimable (hereinafter referred to as "claimable invention" where appropriate). Each of the forms of the invention is numbered like the appended claims and depends from the other form or forms, where appropriate. This is for easier understanding of the claimable invention, and it is to be understood that combinations of constituent elements that constitute the invention are not limited to those described in the following forms. That is, it is to be understood that the claimable invention shall be construed in the light of the following descriptions of various forms and embodiments. It is to be further understood that any form in which one or more elements is/are added to or deleted from any one of the following forms may be considered as one form of the claimable invention.

(1) An ink-jet recording apparatus, comprising:

an ink-jet head having a droplet ejecting surface in which a plurality of nozzles from which droplets of ink are ejected are formed in at least one row along a prescribed nozzle arrangement direction, the ink-jet head being movable in a scanning direction parallel to the droplet ejecting surface and intersecting the prescribed nozzle arrangement direction;

a conveyor mechanism configured to move, in a conveyance direction parallel to the droplet ejecting surface and intersecting the scanning direction, at least one of the ink-jet head and a recording medium that is disposed so as to be opposed to the droplet ejecting surface, such that the ink-jet head and the recording medium are moved relative to each other; and a controller configured to control the ink-jet recording apparatus, wherein the controller includes a pattern forming portion configured to form, on the recording medium, an inclination detect pattern for detecting inclination of the at least one nozzle row with respect to the prescribed nozzle arrangement direction due to rotational displacement of the ink-jet head in a plane parallel to the droplet ejecting surface, by controlling the ink-jet head and the conveyor mechanism, and wherein the pattern forming portion is configured to form, as the inclination detect pattern, (A) a first inclination detect pattern including mutually parallel two lines formed by permitting the droplets to be ejected respectively from: a first nozzle group composed of the nozzles that constitute a first section of one of the at least one nozzle row; and a second nozzle group composed of the nozzles that constitute a second section of the one of the at least one nozzle row different from the first section, when the ink-jet head moves in a first direction as one of opposite two directions in the scanning direction, and (B) a second inclination detect pattern including mutually parallel two lines formed by permitting the droplets to be ejected respectively from: the first nozzle group; and the second nozzle group, when the ink-jet head moves in a second direction as the other of the opposite two directions in the scanning direction.

In an instance in which the two lines (two dot rows) are formed by ejecting the droplets respectively from the first nozzle group and the second nozzle group as one and the other of the two sections of the one of the at least one nozzle row, if the actual extension direction of the at least one nozzle row is inclined relative to a normal nozzle arrangement direction, the positions of the respective two lines are shifted in the scanning direction in accordance with the inclination of the at least one nozzle row. Accordingly, it is possible to detect the inclination of the at least one nozzle row from the positional relationship of the two lines in the scanning direction. However, where there is a difference between: the distance (gap) from the first nozzle group to the droplet ejecting surface; and the distance (gap) from the second nozzle group to the droplet ejecting surface, the difference in the distance, i.e., the gap difference, is also a factor to change the positional relationship of the two lines.

It is noted here that the position of the line formed by one of the two nozzle groups, which is opposed to the droplet ejecting surface with a smaller gap existing therebetween, is shifted toward the upstream side in the moving direction of the head because the droplet ejected from this one nozzle group attaches to the recording medium earlier. It is also noted that the position of the line formed by the other of the two nozzle groups, which is opposed to the droplet ejecting surface with a larger gap existing therebetween, is shifted toward the downstream side in the moving direction of the head. Therefore, with the at least one nozzle row inclined, in an instance wherein the one of the nozzle groups with a smaller gap is located more upstream in the moving direction of the head than the other of the nozzle groups with a larger gap, the distance (spacing distance) between the two lines is increased due to the gap difference, as compared with an instance in which no gap difference exist. On the other hand, in an instance wherein the one of the nozzle groups with a smaller gap is located more downstream in the moving direction of the head than the other of the two nozzle groups with a larger gap, the distance (spacing distance) between the two lines is decreased due to the gap difference, as compared with the instance in which no gap difference exist.

Accordingly, in the first inclination detect pattern and the second inclination detect pattern which are formed during the movement of the head in the mutually opposite directions, respective position-shift components in the first inclination detect pattern and the second inclination detect pattern, each of which is contained in the positional relationship (spacing distance) in the scanning direction between the two lines and arises from the gap difference between the first nozzle group and the second nozzle group, have a truly converse relationship. That is, the position-shift component relating to the two lines in the first inclination detect pattern and the position-shift component relating to the two lines in the second inclination detect pattern have the same absolute value and have mutually opposite directions. Therefore, the position-shift components due to the gap difference are offset or canceled using the two kinds of inclination detect patterns, whereby the position-shift component due to the inclination of the at least one nozzle row can be extracted, resulting in accurate detection of the inclination.

On the contrary, a position-shift component relating to the two lines due to the inclination of the at least one nozzle row in the first inclination detect pattern and a position-shift component relating to the two lines due to the inclination of the at least one nozzle row in the second inclination detect pattern are mutually the same. Therefore, on the basis of the positional relationship (spacing distance) in the scanning direction of the two lines in each of the first and second inclination detect patterns, the position-shift components due to the inclination of the at least one nozzle row are offset or canceled, whereby the position-shift component due to the gap difference between the first nozzle group and the second nozzle group can be extracted so as to detect the gap difference.

In the above form, "the conveyor mechanism is configured to move at least one of the ink-jet head and the recording medium" means that the conveyor mechanism moves the ink-jet head relative to the recording medium, the conveyor mechanism moves the recording medium relative to the ink-jet head, or the conveyor mechanism moves the ink-jet head and the recording medium relative to each other.

(2) The ink-jet recording apparatus according to the form (1), wherein the pattern forming portion is configured to form the first inclination detect pattern and the second inclination detect pattern such that at least one of the recording medium and the ink-jet head is moved by the conveyor mechanism in the conveyance direction in a time period between ejection of the droplets from one of the first nozzle group and the second nozzle group and ejection of the droplets from the other of the first nozzle group and the second nozzle group, in each of formation of the first inclination detect pattern and formation of the second inclination detect pattern.

In the above form, after the droplets have been ejected from the one of the first and second nozzle groups, at least one of the recording medium and the ink-jet head is moved by the conveyor mechanism before the droplet is ejected from the other of the first and second nozzle groups. In the time period between formation of one of the two lines by the first nozzle group and formation of the other of the two lines by the second nozzle group, which first and second nozzle groups constitute mutually different sections of the one of the at least one nozzle row, the recording medium and the head are conveyed relative to each other, whereby the positions of the respective two lines can be located adjacent to each other in the scanning direction. Hence, it is easy to obtain the position shift of the two lines in the scanning direction which arises from the inclination of the at least one nozzle row and the gap difference between the two nozzle groups.

(3) The ink-jet recording apparatus according to the form (2), wherein the pattern forming portion is configured to permit the droplets to be ejected from each of the first nozzle group and the second nozzle group at a timing in which one of the two lines formed by the first nozzle group and the other of the two lines formed by the second nozzle group would overlap each other, in each of the formation of the first inclination detect pattern and the formation of the second inclination detect pattern.

By controlling the droplet ejection timing such that the one of the two lines formed by the first nozzle group and the other of the two lines formed by the second nozzle group would overlap each other in an instance where there exist no inclination of the nozzle row and no gap difference between the two nozzle groups, for example, it is more easy to obtain the position shift of the two lines in the scanning direction due to the inclination of the at least one nozzle row and the gap difference between the nozzle groups.

(4) The ink-jet recording apparatus, according to any one of the forms (1)-(3), wherein the controller further includes an inclination detect portion configured to detect the inclination of the at least one nozzle row on the basis of a recognition result of the first inclination detect pattern and the second inclination detect pattern formed on the recording medium, and wherein the inclination detect portion is configured to obtain a distance in the scanning direction between the two lines in the first inclination detect pattern and a distance in the scanning direction between the two lines in the second inclination detect pattern and to detect the inclination of the at least one nozzle row on the basis of a sum of the distances.

As described above, in the first inclination detect pattern and the second inclination detect pattern which are formed during the movement of the head in the mutually opposite directions, the respective position-shift components in the first inclination detect pattern and the second inclination detect pattern, each of which is contained in the positional relationship (spacing distance) in the scanning direction of the two lines and arises from the gap difference between the first nozzle group and the second nozzle group, have a truly converse relationship. Accordingly, the inclination detect portion obtains the sum of the distances in the first inclination detect pattern and the second inclination detect pattern, whereby the position-shift components due to the gap difference are offset or canceled so as to extract the position-shift component due to the inclination of the at least one nozzle row. Thus, the inclination of the at least one nozzle row can be accurately detected.

(5) The ink-jet recording apparatus according to the form (4), wherein the controller further includes a gap-difference detect portion configured to detect a gap difference which is a difference between: a distance between the droplet ejecting surface and the recording medium at a position where the first nozzle group is disposed; and a distance between the droplet ejecting surface and the recording medium at a position where the second nozzle group is disposed, on the basis of the recognition result of the first inclination detect pattern and the second inclination detect pattern formed on the recording medium, and wherein the gap-difference detect portion is configured to detect the gap difference on the basis of a difference between: the distance in the scanning direction between the two lines in the first inclination detect pattern; and the distance in the scanning direction between the two lines in the second inclination detect pattern.

The position-shift component relating to the two lines due to the inclination of the at least one nozzle row in the first inclination detect pattern and the position-shift component relating to the two lines due to the inclination of the at least one nozzle row in the second inclination detect pattern are mutually the same. Accordingly, in contrast with the above form (4), the gap-difference detect portion obtains a difference between: the distance in the scanning direction between the two lines in the first inclination detect pattern; and the distance in the scanning direction between the two lines in the second inclination detect pattern, whereby the position-shift components due to the inclination of the at least one row are offset or canceled so as to extract the position-shift component due to the gap difference between the first nozzle group and the second nozzle group. Thus, the gap difference between the two nozzle groups can be detected.

(6) The ink-jet recording apparatus according to any one of the forms (3)-(5), wherein the pattern forming portion is configured to form the first inclination detect pattern and the second inclination detect pattern each of which includes (a) one line as the one of the two lines formed by the one of the first nozzle group and the second nozzle group and (b) a plurality of lines each of which is the other of the two lines formed by the other of the first nozzle group and the second nozzle group and which are mutually different in position in the scanning direction, and wherein the pattern forming portion is configured to permit the droplets to be ejected from the second nozzle group at a timing in which one of the plurality of lines functions as a reference line that would overlap the one line in an instance in which no inclination of the at least one nozzle low with respect to the prescribed nozzle arrangement direction exists and no gap difference exists, the gap difference being a difference between: a distance between the droplet ejecting surface and the recording medium at a position where the first nozzle group is disposed; and a distance between the droplet ejecting surface and the recording medium at a position where the second nozzle group is disposed.

In the above form, the one line is formed by the one of the first nozzle group and the second nozzle group while the plurality of lines including the reference line are formed by the other of the first nozzle group and the second nozzle group. Further, the distance between adjacent two of the plurality of lines formed by the other of the first and second nozzle groups can be obtained from the position of the head in the scanning direction at a time point when each line is formed. Therefore, by regarding that the one line formed by the one of the two nozzle groups overlaps one of the plurality of lines formed by the other of the two nozzle groups that is the closest to the one line, it is possible to easily obtain the distance between the one line and the reference line. Accordingly, the inclination of the at least one nozzle row can be easily detected.

(7) The ink-jet recording apparatus according to the form (6), wherein the controller further includes an inclination detect portion configured to detect the inclination of the at least one nozzle row on the basis of a recognition result of the first inclination detect pattern and the second inclination detect pattern formed on the recording medium, and wherein the inclination detect portion is configured to (i) regard that the one line formed by the one of the first nozzle group and the second nozzle group overlaps one of the plurality of lines which is formed by the other of the first nozzle group and the second nozzle group and which is the closest to the one line in the scanning direction and (ii) obtain a distance between the one line and the reference line in the scanning direction on the basis of a position of the ink-jet head at a time point when the closest line is formed, for each of the first inclination detect pattern and the second inclination detect pattern, and wherein the inclination detect portion is configured to detect the inclination of the at least one nozzle row on the basis of the distance in the first inclination detect pattern and the distance in the second inclination detect pattern.

In the above form, where the ink-jet recording apparatus is equipped with an input portion, for instance, the one of the plurality of lines formed by the other of the two nozzle groups that is closest to the one line formed by the one of the two nozzle groups may be selected and inputted through the input portion. In this instance, the inclination detect portion regards that the one line formed by the one of the two nozzle groups overlaps the closest line selected and inputted through the input portion, whereby it is possible to easily obtain the distance between the one line and the reference line in the scanning direction, resulting in easy detection of the inclination of the at least one nozzle row.

(8) The ink-jet recording apparatus according to any one of the forms (1)-(7), wherein the pattern forming portion is configured to form:

(A) the first inclination detect pattern including mutually parallel three lines formed by permitting the droplets to be ejected respectively from: the first nozzle group; the second nozzle group; and a third nozzle group composed of the nozzles that constitute a third section of the one of the at least one nozzle row different from the first section and the second section, when the ink-jet head moves in the first direction, and (B) the second inclination detect pattern including mutually parallel three lines formed by permitting the droplets to be ejected respectively from: the first nozzle group; the second nozzle group; and the third nozzle group, when the ink-jet head moves in the second direction.

The surface of the recording medium is not always flat, but its central portion in the conveyance direction may be slightly convex or concave due to some factors such as a layout relationship between a platen on which the recording medium is placed and rollers for conveying the recording medium. In the above form, the droplets are ejected respectively from the three nozzle groups that constitute the one of the at least one nozzle row so as to form the three lines, thereby making it possible to detect the gap differences among the three nozzle groups. Accordingly, it is possible to more accurately obtain the gap differences, in one of the at least one nozzle row, between the droplet ejecting surface and the recording medium.

(9) A method of detecting inclination of a nozzle row of an ink-jet head of an ink-jet recording apparatus, wherein the ink-jet recording apparatus includes:

the ink-jet head having a droplet ejecting surface in which a plurality of nozzles from which droplets of ink are ejected are formed in at least one row along a prescribed nozzle arrangement direction, the ink-jet head being movable in a scanning direction parallel to the droplet ejecting surface and intersecting the prescribed the nozzle arrangement direction; and a conveyor mechanism configured to move, in a conveyance direction parallel to the droplet ejecting surface and intersecting the scanning direction, at least one of the ink-jet head and a recording medium that is disposed so as to be opposed to the droplet ejecting surface, such that the ink-jet head and the recording medium are moved relative to each other, wherein the method is for detecting inclination of the at least one nozzle row with respect to the prescribed nozzle arrangement direction due to rotational displacement of the ink-jet head in a plane parallel to the droplet ejecting surface and comprise:

a pattern forming step of forming on the recording medium (A) a first inclination detect pattern including mutually parallel two lines by permitting the droplets to be ejected respectively from: a first nozzle group formed of the nozzles that constitute a first section of one of the at least one nozzle row; and a second nozzle group formed of the nozzles that constitute a second section of the one of the at least one nozzle row different from the first section, when the ink-jet head moves in a first direction as one of opposite two directions in the scanning direction and (B) a second inclination detect pattern including mutually parallel two lines by permitting the droplets to be ejected respectively from: the first nozzle group; and the second nozzle group, when the ink-jet head moves in a second direction as the other of the opposite two directions in the scanning direction, and an inclination detecting step including: obtaining a distance in the scanning direction between the two lines in the first inclination detect pattern formed on the recording medium and a distance in the scanning direction between the two lines in the second inclination detect pattern formed on the recording medium; and detecting the inclination of the at least one nozzle row detected on the basis of a sum of the distances.

By obtaining the sum of the distances in the first and second inclination detect patterns described above, the position-shift component due to the gap difference relating to the two lines formed by the first and second nozzle groups in the first inclination detect pattern and the position-shift component due to the gap difference relating to the two lines formed by the first and second nozzle groups in the second inclination detect pattern are offset or canceled, whereby the position-shift component due to the inclination of the at least one nozzle row can be extracted so as to accurately detect the inclination of the at least one nozzle row, and accordingly the inclination of the head.

In the above form, "the conveyor mechanism is configured to move at least one of the ink-jet head and the recording medium" means that the conveyor mechanism moves the ink-jet head relative to the recording medium, the conveyor mechanism moves the recording medium relative to the ink-jet head, or the conveyor mechanism moves the ink-jet head and the recording medium relative to each other

(10) The method according to the form (9), further comprising a gap-difference detecting step of detecting a gap difference which is a difference between: a distance between the droplet ejecting surface and the recording medium at a position where the first nozzle group is disposed; and a distance between the droplet ejecting surface and the recording medium at a position where the second nozzle group is disposed, on the basis of a difference: between the distance in the scanning direction between the two lines in the first inclination detect pattern formed on the recording medium; and the distance in the scanning direction between the two lines in the second inclination detect pattern formed on the recording medium.

By obtaining the difference between the distance in the first inclination detect pattern and the distance in the second inclination detect pattern, the position-shift components due to the inclination of the at least one nozzle row in the respective first and second inclination detect patterns are offset or canceled, whereby the position-shift component due to the gap difference between the first nozzle group and the second nozzle group is extracted so as to detect the gap difference.

BRIEF DESCRIPTION OF THE DRAWINGS

The above and other objects, features, advantages and technical and industrial significance of the present invention will be better understood by reading the following detailed description of embodiments of the invention, when considered in connection with the accompanying drawings, in which.

DETAILED DESCRIPTION OF THE EMBODIMENTS

There will be explained one preferred embodiment of the present invention with reference to the drawings.

Figure 1:
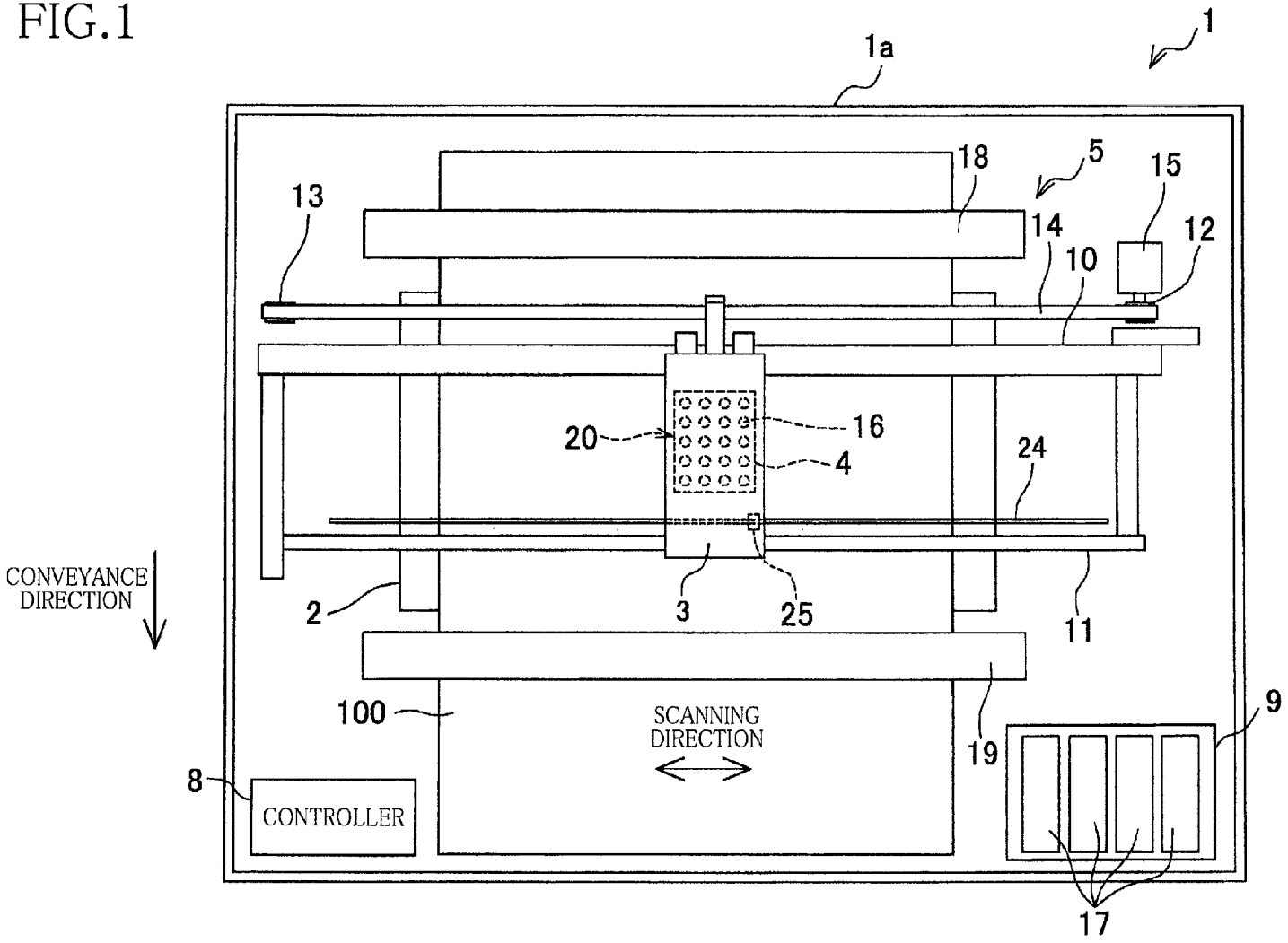
FIG. 1 is a schematic plan view of an ink-jet printer according to one embodiment of the invention.
Figure 2:
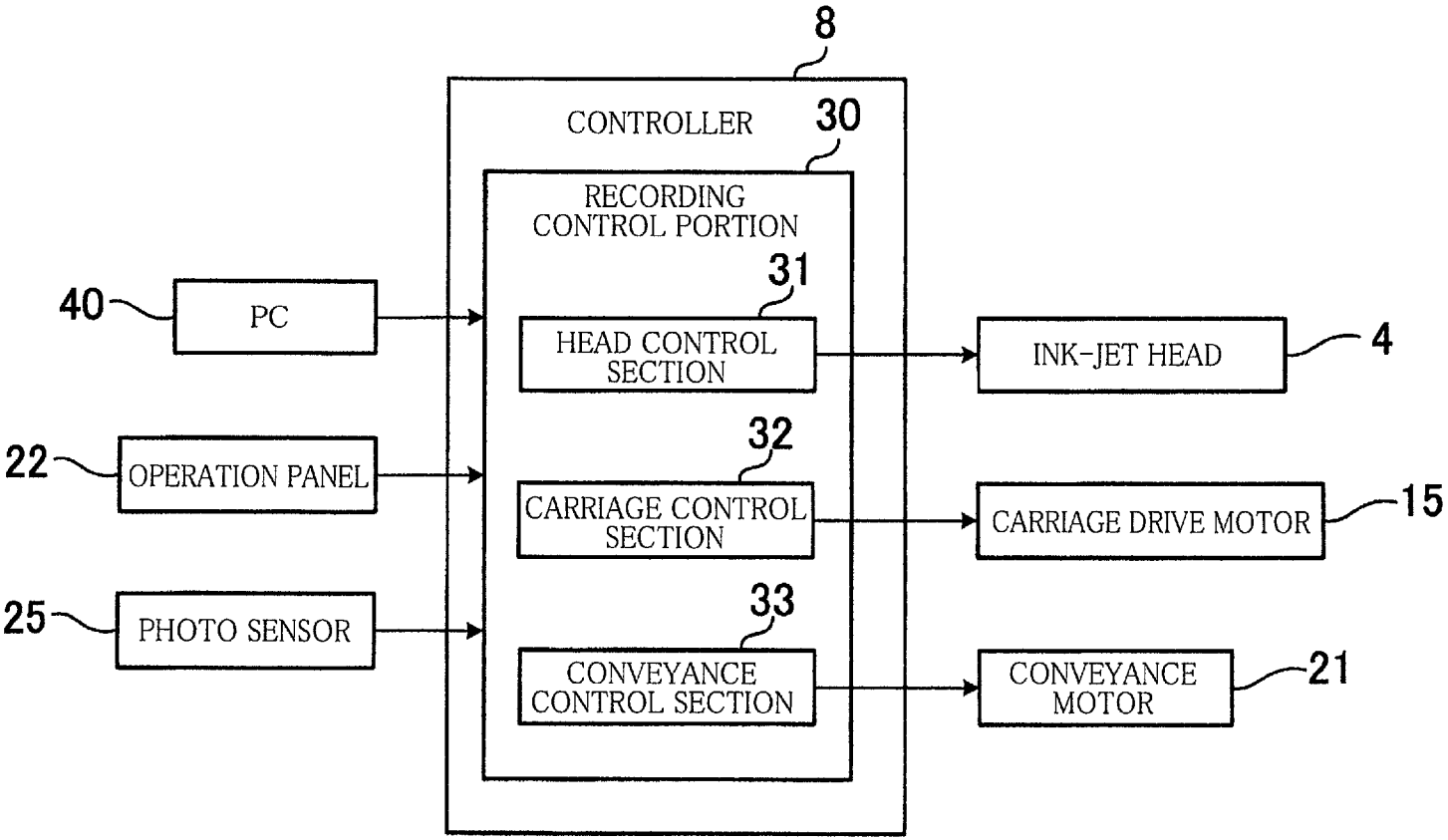
FIG. 2 is a block diagram showing a control system of the ink-jet printer.

As shown in the schematic plan view of FIG. 1 and the block diagram of FIG. 2, an ink-jet printer 1 according to the present embodiment, as an ink-jet recording apparatus of the invention, includes: a platen 2 on which is placed a recording sheet 100 as a recording medium; a carriage 3 which is reciprocatingly movable in a scanning direction parallel to the platen 2; an ink-jet head 4 mounted on the carriage 3; a conveyor mechanism 5 configured to convey the recording sheet 100 in a conveyance direction orthogonal to the scanning direction; and a controller 8 configured to control the ink-jet printer 1 as a whole.

<Schematic Structure of Printer>

The recording sheet 100 is placed on the horizontal upper surface of the platen 2. Two parallel guide rails 10, 11 are disposed over platen 2 so as to extend in the left-right direction in FIG. 1, namely, in the scanning direction. The carriage 3 is reciprocatingly movable in the scanning direction along the two guide rails 10, 11 in a region in which the carriage 3 is opposed to the recording sheet 100 on the platen 2. To the carriage 3, an endless belt 14 wound around and stretched between two pulleys 12, 13 is connected. When the endless belt 14 moves by being driven by a carriage drive motor 15, the carriage 3 moves in the scanning direction by the movement of the endless belt 14.

In a printer main body la, there is provided a linear encoder 24 having a multiplicity of light transmitting portions (i.e., slits) arranged so as to be spaced apart from each other in the scanning direction. On the other hand, the carriage 3 is provided with a photo sensor 25 constituted by a transmission photo sensor having light emitting elements and light receiving elements. The printer 1 is configured to obtain or recognize a current position of the carriage 3 (the ink-jet head 4) with respect to the scanning direction, from a value of count (number of times of detection) of the light transmitting portions of the linear encoder 24 detected by the photo sensor 25 during the movement of the carriage 3.

The ink-jet head 4 is attached to the lower portion of the carriage 3. The lower surface of the ink-jet head 4 (corresponding to the back surface of the sheet plane of FIG. 1) functions as a droplet ejecting surface 4*a* (FIG. 5) in which a plurality of nozzles 16 are open. The droplet ejecting surface 4*a* is parallel to the upper surface of the platen 2 and is to be opposed to the recording sheet 100 on the platen 2. The nozzles 16 are arranged along the conveyance direction in four rows from which are respectively ejected inks of mutually different colors, i.e., black, yellow, cyan, and magenta, so as to form four nozzle rows 20.

As shown in FIG. 1, a holder 9 is fixedly disposed in the printer main body 1*a*. There are installed, on the holder 9, four ink cartridges 17 which respectively store the four inks of the mutually different colors to be ejected from the respective four nozzle rows 20. While not illustrated, the ink-jet head 4 mounted on the carriage 3 and the holder 9 are connected by four tubes (not shown) through which the respective four inks in the four ink cartridges 17 are supplied to the ink-jet head 4. The ink-jet head 4 is configured to eject the four inks from the nozzles 16 to the recording sheet 100 on the platen 2.

The conveyor mechanism 5 includes two conveyance rollers 18, 19 disposed so as to sandwich, therebetween, the platen 2 and the carriage 3 in the conveyance direction. The two conveyance rollers 18, 19 are configured to be rotatably driven by a conveyance motor 21 (FIG. 2), so that the recording sheet 100 on the platen 2 is conveyed in the conveyance direction.

In the ink-jet printer 1, the inks are ejected from the ink-jet head 4 to the recording sheet 100 placed on the platen 2 while the carriage 3 is moved in the scanning direction, namely, in the left-right direction in FIG. 1, and at the same time the recording sheet 100 is conveyed by the two conveyance rollers 18, 19 in the conveyance direction, namely, in the downward direction in FIG. 1, whereby images and characters are recorded on the recording sheet 100.

The controller 8 shown in FIG. 2 is equipped with a microcomputer including: a Central Processing Unit (CPU); a Read Only Memory (ROM) which stores various programs and data for controlling overall operations of the printer 1; and a Random Access Memory (RAM) which temporarily stores data and the like processed by the CPU. The programs stored in the ROM are executed by the CPU, whereby various controls explained below are executed. Alternatively, the controller 8 may be hardware in which various circuits including arithmetic circuits are combined.

To the controller 8, various signals relating to a recording operation are inputted from a personal computer (PC) 40 as an external device and an operation panel 22 of the printer 1. The controller 8 includes a recording control portion 30 including: a head control section 31 configured to control an ink ejecting operation of the ink-jet head 4; a carriage control section 32 configured to control the carriage drive motor 15 for driving the carriage 3 to move in the scanning direction; and a conveyance control section 33 configured to control the conveyance motor 21 for driving the conveyance rollers 18, 19. The recording control portion 30 is configured to control the ink-jet head 4, the carriage drive motor 15, and the conveyance motor 21 of the conveyor mechanism 5, on the basis of image data inputted from the PC 40, so as to carry out recording on the recording sheet 100.

In the meantime, when the printer 1 of the present embodiment is manufacture (assembled), there may be an instance wherein the ink-jet head 4 is attached in a posture in which the ink-jet head 4 is inclined or rotated in a horizontal plane parallel to the droplet ejecting surface 4*a*, namely, in a plane parallel to the sheet plane of FIG. 1, relative to a prescribed normal posture. In this instance, the nozzles rows 20 are inclined, in other words, the direction of extension of the nozzle rows 20 is inclined, relative to a normal nozzle arrangement direction (here, relative to the conveyance direction). For instance, there are an instance in which the ink-jet head 4 is attached to the carriage 3 in an inclined posture relative to the normal posture or the carriage 3 per se on which the ink-jet head 4 is mounted is attached to the two guide rails 10, 11 in an inclined posture.

Such inclination of the nozzle rows 20 generates inclination of dot rows on the recording sheet 100, degrading the image quality. Accordingly, it is desirable to initially detect the inclination of the nozzle rows 20 and then to perform various adjustment in accordance with the detected inclination, thereby minimizing an influence of the image quality. In view of this, in the printer 1 according to the present embodiment, the recording control portion 30 of the controller 8 controls the ink-jet head 4, the carriage drive motor 15, and the conveyance motor 21 of the conveyor mechanism 5, so as to form, on the recording sheet 100, inclination detect patterns for detecting the inclination of the nozzle rows 20. It is noted that the recording control portion 30 corresponds to a pattern forming portion.

<Details of Detection of Inclination>

There will be explained details of the inclination detect patterns formed on the recording sheet 100 and an inclination detecting method using the inclination detect patterns. Each of FIGS. 3 and 4 is a view for explaining a process of forming the inclination detect pattern.

Each of the inclination detect patterns which will be explained below is formed by using two nozzle groups, i.e., a first nozzle group 41 and a second nozzle group 42, which are constituted by mutually different two sections, i.e., a first section and a second section, in one nozzle row 20. In the present embodiment, the first nozzle group 41 is located at an upstream end portion of the one nozzle row 20 in the conveyance direction while the second nozzle group 42 is located at a downstream end portion of the one nozzle 20. Further, in the present embodiment, the number of the nozzles 16 constituting the first nozzle group 41 and the number of the nozzles 16 constituting the second nozzle group 42 are the same, and the first nozzle group 41 and the second nozzle group 42 have the same length. A distance between the two nozzle groups 41, 42 along a direction of the nozzle row 20 is made equal to L. More specifically, in FIGS. 3 and 4, a distance between the most upstream one of the nozzles 16 of the first nozzle group 41 in the conveyance direction and the most upstream one of the nozzles 16 of the second nozzle group 42 in the conveyance direction is made equal to L.

<First-Pattern Forming Step>

Figure 3A:
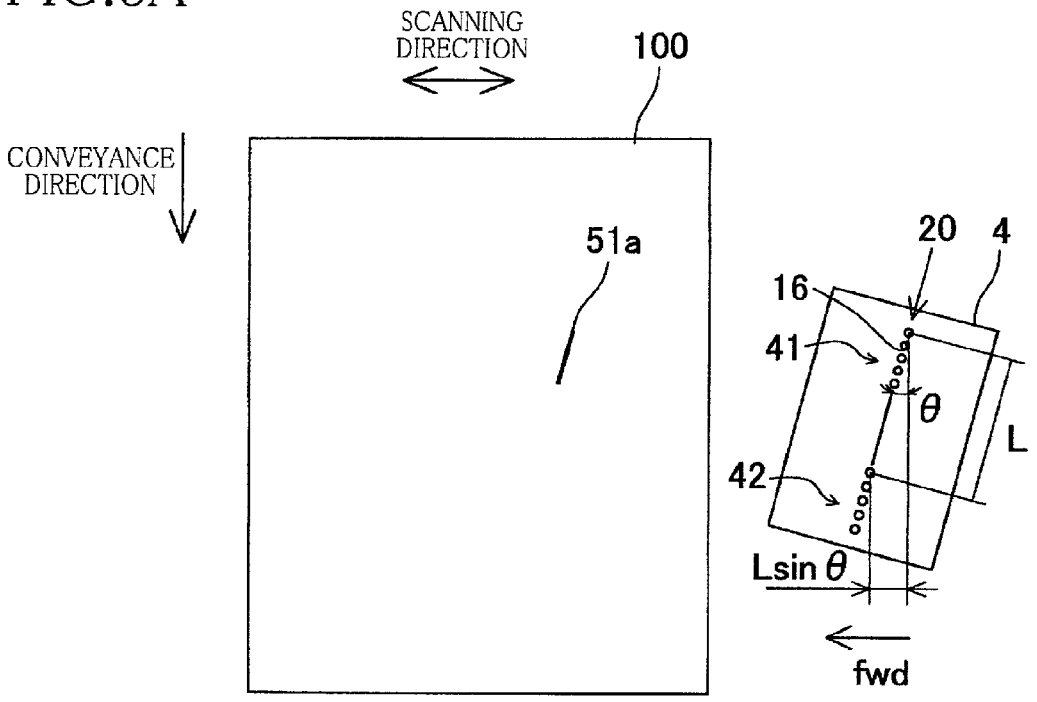
FIGS. 3A and 3B are views for explaining a first-pattern forming step.
Figure 3B:
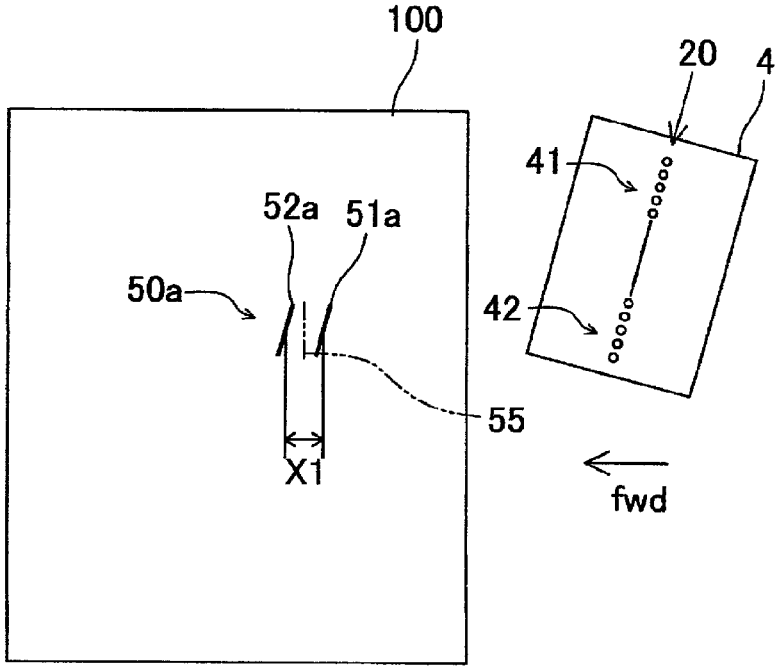

As shown in FIG. 3, the ink is ejected concurrently from the nozzles 16 which constitute the first nozzle group 41 of the ink-jet head 4 while the carriage 3 on which the ink-jet head 4 is mounted is moved in one of opposite two directions in the scanning direction, namely, in a forward (fwd) direction, whereby a line 51*a* is formed on the recording sheet 100 as shown in FIG. 3A. Here, where the nozzle row 20 is inclined, as shown in FIG. 3, with respect to the conveyance direction which is a normal nozzle arrangement direction, the line 51*a* is also inclined with respect to the conveyance direction by an amount corresponding to the inclination, namely, the line 51*a* is inclined by an angle θ. Subsequently, after the recording sheet 100 has been conveyed by the conveyor mechanism 5 in the conveyance direction with respect to the ink-jet head 4, the ink is ejected concurrently from the nozzles 16 which constitute the second nozzle group 42 while the carriage 3 is again moved in the above-indicated one direction, namely, in the forward direction, whereby a line 52*a* parallel to the line 51*a* is formed on the recording sheet 100 as shown in FIG. 3B. That is, during the movement of the ink-jet head 4 in the forward direction, a first inclination detect pattern 50*a* composed of the two parallel lines 51*a*, 52*a* is formed by the two nozzle groups 41, 42.

As described above, by conveying the recording sheet 100 in the conveyance direction in a time period between formation of the line 51*a* by the first nozzle group 41 (FIG. 3A) and formation of the line 52*a* by the second nozzle group 42, the positions of the respective two lines 51*a*, 52*a* in the conveyance direction are made close to each other.

In the present embodiment, in particular, the recording sheet 100 is conveyed by the distance L by which the two nozzle groups 41, 42 are spaced apart from each other, whereby the positions of the respective two lines 51, 52 in the conveyance direction coincide with each other as shown in FIG. 3B. Further, for permitting the positions of the two lines 51*a*, 52*a* in the scanning direction to coincide with each other so as to overlap each other in an instance where the ink-jet head 4 is normally assembled with no inclination of the nozzle rows 20, more specifically, also with no gap difference between the two nozzle groups 41, 42, the droplet ejection timings of the first nozzle group 41 and the second nozzle group 42 are controlled. More specifically, the droplet ejection timing of the nozzles 16 when the line 51*a* is formed by the first nozzle group 41 and the droplet ejection timing of the nozzles 16 when the line 52*a* is formed by the second nozzle group 42 are conformed to each other. That is, the position of the ink-jet head 4 in the scanning direction detected by the photo sensor 25 when the droplets are ejected for forming the line 51*a* and the position of the ink-jet head 4 in the scanning direction detected by the photo sensor 25 when the droplets are ejected for forming the line 52*a* are conformed to each other. In other words, in an instance where the nozzle row 20 is not inclined, more specifically, also in an instance where no gap difference between the two nozzle groups 41, 42 exist, the line 51*a* and the line 52*a* overlap each other so as to become one line 55 (indicated by the long dashed double-short dashed line in FIG. 3B) that is parallel to the conveyance direction. However, because of the inclination of the nozzle row 20, the line 51*a* and the line 52*a* are inclined, and the respective positions of the line 51*a* and the line 52*a* are shifted in the scanning direction.

<Second-Pattern Forming Step>)

Figure 4A:
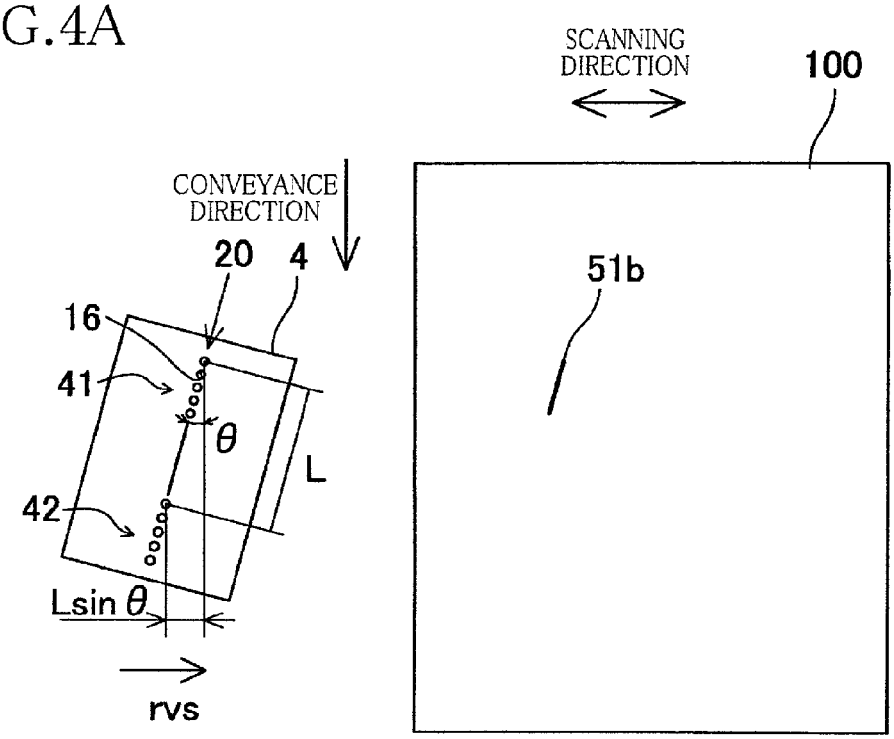
FIGS. 4A and 4B are views for explaining a second-pattern forming step.
Figure 4B:
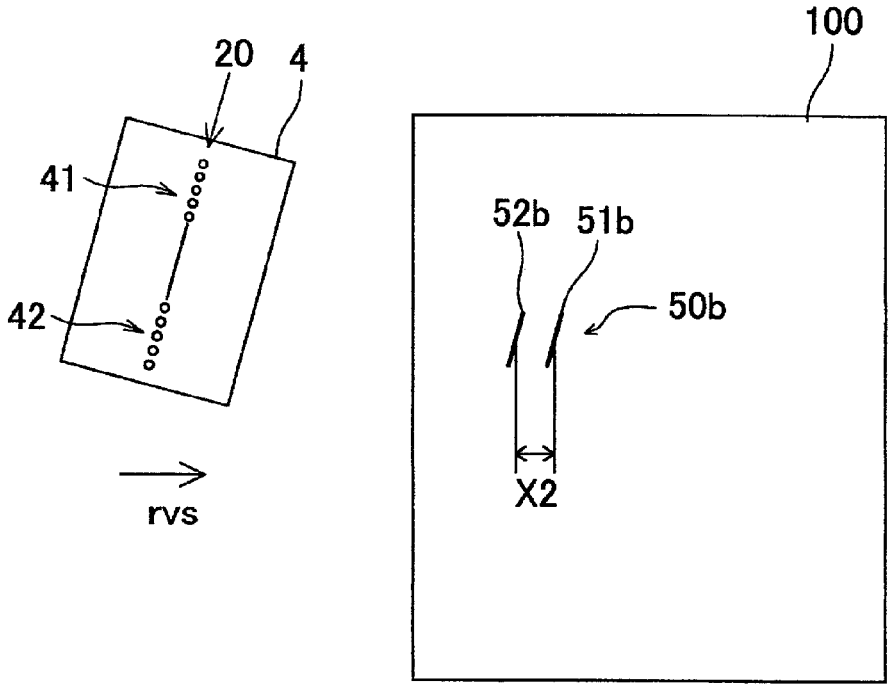

A second inclination detect pattern 50*b* is formed on the recording sheet 100 while the ink-jet head 4 is moved in the direction opposite to the direction in which the ink-jet head 4 is moved in the above-described first-pattern forming step. That is, as shown in FIG. 4A, the ink is ejected from the first nozzle group 41 while the carriage 3 on which the ink-jet head 4 is mounted is moved in the other of the opposite two directions in the scanning direction, namely, in a reverse (rvs) direction, whereby a line 51*b* is formed. Subsequently, after the recording sheet 100 has been conveyed by the conveyor mechanism 5 in the conveyance direction with respect to the ink-jet head 4, the ink is ejected from the second nozzle group 42 while the carriage 3 is moved aging in the reverse direction, whereby a line 52*b* is formed, as shown in FIG. 4B. That is, during the movement of the ink-jet head 4 in the reverse direction, the second inclination detect pattern 50*b* composed of the two parallel lines 51*b*, 52*b* are formed by the two nozzle groups 41, 42.

In this second-pattern forming step, the control for permitting the two lines 51*b*, 52*b* to overlap each other is also executed in an instance in which the ink-jet head 4 is normally attached with no inclination of the nozzle row 20, more specifically also with no gap difference between the two nozzle groups 41, 42. That is, in a time period between formation of the line 51*b* (FIG. 4A) and formation of the line 52*b* (FIG. 4B), the recording sheet 100 is conveyed by the distance L by which the two nozzle groups 41, 42 are spaced apart from each other, and the droplet ejection timings of the respective two nozzle groups 41, 42 are conformed to each other.

Actually, the first inclination detect pattern 50*a* and the second inclination detect pattern 50*b* are efficiently formed in the following manner. Initially, the head 4 is reciprocated in the scanning direction, namely, the head 4 is moved first in the forward direction and subsequently in the reverse direction, so as to form the line 51*a* of the first inclination detect pattern 50*a* shown in FIG. 3A and the line 51*b* of the second inclination detect pattern 50*b* shown in FIG. 4A, by the first nozzle group 41. Subsequently, after the recording sheet 100 has been conveyed by the distance L, the head 4 is reciprocated in the scanning direction, namely, the head 4 is moved first in the forward direction and subsequently in the reverse direction, so as to form the line 52*a* of the first inclination detect pattern 50*a* shown in FIG. 3B and the line 52*b* of the second inclination detect pattern 50*b* shown in FIG. 4B, by the second nozzle group 42. In other words, the first-pattern forming step and the second-pattern forming step may be considered as one pattern forming step in which the first-pattern forming step and the second-pattern forming step are carried out in parallel with each other.

<Inclination Detecting Step>

Next, for each of the first inclination detect pattern 50*a* and the second inclination detect pattern 50*b* formed on the recording sheet 100, the distance X1; X2 in the scanning direction between the two lines 51*a*, 52*a*; 51*b*, 52*b* is detected, and the inclination θ of the nozzle row 20 is obtained using the detected distance X1; X2. For instance, the distance X1; X2 may be detected by a dedicated detecting device having an optical sensor or the like. Alternatively, by taking an image of the inclination detect pattern 50*a*; 50*b* by a high-resolution camera, the distance X1; X2 may be detected by image analysis.

Where the nozzle row 20 is inclined, the positions of the respective two lines 51, 52 in the scanning direction are shifted as shown in FIG. 3B and FIG. 4B. The position shift X1; X2 of the two lines 51, 52 (i.e., the distance between the two lines 51, 52 in the scanning direction) is equal to the distance between the two nozzle groups 41, 42 in the scanning direction, and accordingly, X1; X2 is equal to L sin θ (X1; X2=L sin θ). As apparent from the above, where the position shift of the two lines 51, 52 is caused only by the inclination of the nozzle row 20, irrespective of the moving direction of the ink-jet head 4, namely, irrespective of whether the ink-jet head 4 is moved in the forward direction or the reverse direction, the position shift of the two lines 51, 52 due to the inclination of the nozzle row 20 is represented as X1=X2.

However, there may be an instance in which a difference exists between: a gap (distance) between the droplet ejecting surface 4*a* and the recording sheet 100 at a position where the first nozzle group 41 is disposed; and a gap (distance) between the droplet ejecting surface 4*a* and the recording sheet 100 at a position where the second nozzle group 42 is disposed. For example, the platen 2 shown in FIG. 1 may be inclined relative to the horizontal surface or the height positions of the respective two conveyance rollers 18, 19 between which the platen 2 is interposed may slightly differ from each other, due to assembling errors or the like. The positions of the respective two lines 51, 52 in the scanning direction are also changed due to such a gap difference between the two nozzle groups 41, 42. FIG. 5 is a view for explaining an influence of the gap difference on the position shift of the two lines 51, 52. In the following explanation, a gap g1 between the droplet ejecting surface 4*a* and the recording sheet 100 at the first nozzle group 41 located at the upstream portion of the nozzle row 20 in the conveyance direction is smaller than a prescribed reference value g0. Further, a gap g2 between the droplet ejecting surface 4*a* and the recording sheet 100 at the second nozzle group 42 located at the downstream portion of the nozzle row 20 in the conveyance direction is larger than the prescribed reference value g0.

Figure 5A:
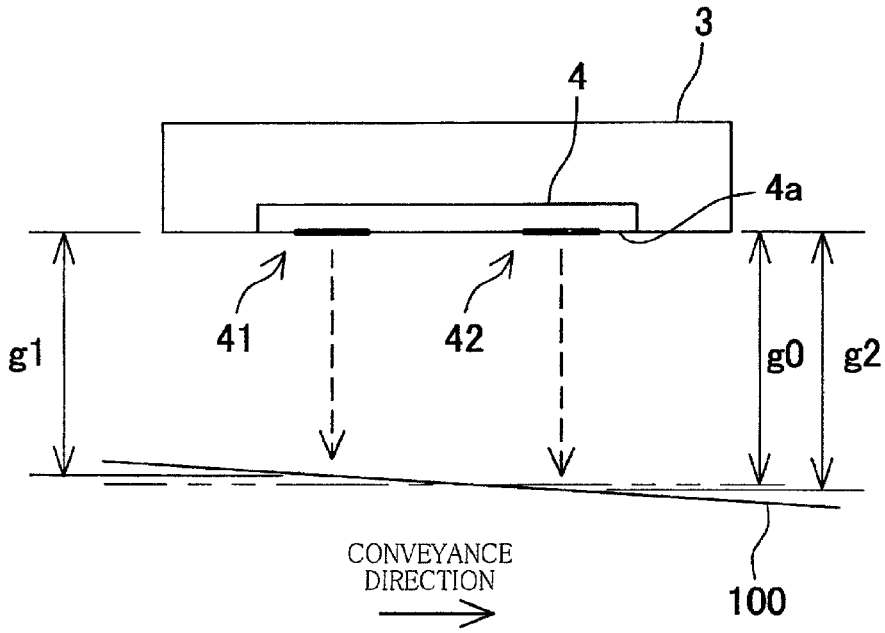
FIGS. 5A and 5B are views for explaining an influence of a gap difference on position shifts of two lines.

The smaller the gap between the droplet ejecting surface 4*a* and the recording sheet 100, the earlier the ink droplets ejected from the nozzles 16 attach to the recording sheet 100. Accordingly, as shown in FIG. 5A, the position of the line 51 formed by the first nozzle group 41 with a smaller gap is shifted toward the upstream side in the moving direction of the ink-jet head, as compared with the position thereof (indicated by the long dashed double-short dashed line) formed when the gap is equal to the reference value g0. On the contrary, the position of the line 52 formed by the second nozzle group 42 with a larger gap is shifted toward the downstream side in the moving direction of the ink-jet head 4, as compared with the position thereof when the gap is equal to the reference value g0.

Figure 5B:
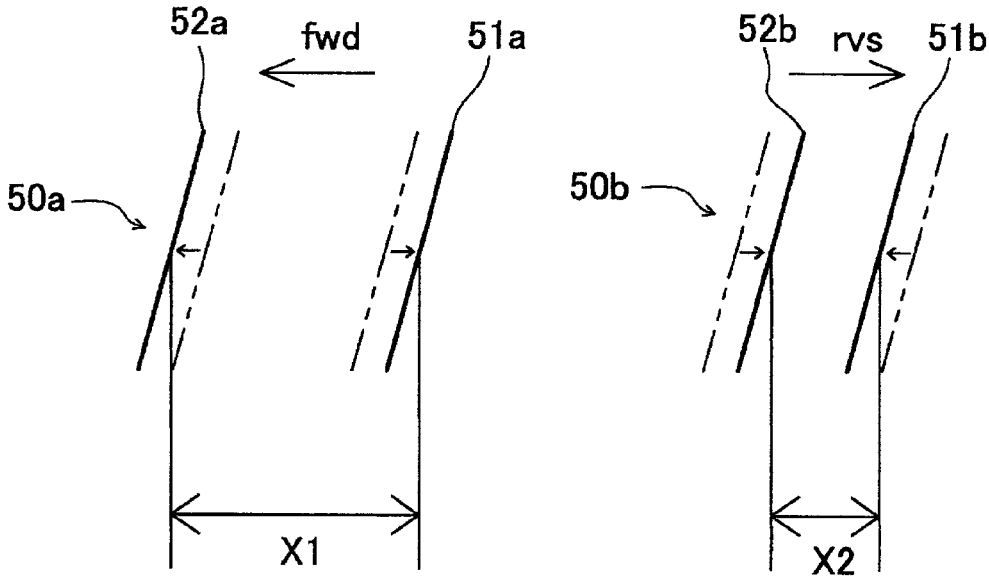

In the state in which the nozzle row 20 is inclined as shown in FIGS. 3 and 4, when the ink-jet head 4 moves in the forward direction (i.e., in the first-pattern forming step), the distance X1 between the two lines 51*a*, 52*a* is increased as shown in the left-side view of FIG. 5B, due to the existence of the gap difference because the first nozzle group 41 with a smaller gap is located more upstream than the second nozzle group 42 with a larger gap, in the moving direction of the head 4. On the contrary, when the ink-jet head 4 moves in the reverse direction (i.e., in the second-pattern forming step), the distance X2 between the two lines 51*b*, 52*b* is decreased as shown in the right-side view of FIG. 5B, due to the existence of the gap difference. In other words, in the first and second inclination detect patterns 50*a*, 50*b*, the position-shift components due to the gap difference between the first nozzle group 41 and the second nozzle group 42, each of which is contained in the distance X1; X2 between the two lines 51, 52, have a converse relationship. That is, the distance X1; X2 is represented as follows:

$$X1=L\sin\theta-p$$

$$X2=L\sin\theta+p$$

wherein p represents the position-shift component relating to the two lines due to the gap difference.

Therefore, by adding the distance X1 between the two lines 51*a*, 52*a* in the first inclination detect pattern 50*a* and the distance X2 between the two lines 51*b*, 52*b* in the second inclination detect pattern 50*b*, the position-shift components p due to the gap difference can be offset or canceled. That is, the following formula is established:

$$L\sin\theta=(X1+X2)/2$$

Accordingly, only the position-shift component (L sin θ) due to the inclination of the nozzle row 20 can be extracted, and the inclination angle θ can be obtained since L is known. As apparent from the above formula, the larger the distance L between the two nozzle groups 41, 42, the larger the position-shift component due to the inclination of the nozzle row 20, so that the detection accuracy is enhanced. Accordingly, in the present embodiment, the two nozzle groups 41, 42 are set as two nozzle groups located at one and the other of the opposite end portions of the nozzle row 20, for the purpose of maximizing the distance "L".

On the basis of the thus obtained inclination angle θ of the nozzle row 20, the inclination of the ink-jet head 4 or the inclination of the carriage 3 per se on which the head 4 is mounted (the attachment angle) can be adjusted, such that the direction of extension of the nozzle row 20 is parallel to the conveyance direction. Alternatively, the inclination of the nozzle row 20 may be maintained as it is, and the droplet ejection timings of the respective nozzles 16 that constitute the nozzle row 20 may be adjusted in accordance with the inclination of the nozzle row 20. It is noted that the adjustment of the inclination of the head 4 or the adjustment of the droplet ejection timings of the nozzles 16 may be carried out in accordance with the value of the position-shift component (L sin θ) due to the inclination of the nozzle row 20, without obtaining the inclination angle θ.

<Gap-Difference Detecting Step>

As explained above, the position- shift components L sin θ relating to the two lines 51, 52 due to the inclination of the nozzle row 20 in the respective first and second inclination detect patterns 50*a*, 50*b* are mutually the same. Therefore, contrary to the above-described inclination detecting step, by subtracting the distance X2 between the two lines 51*b*, 52*b* in the second inclination detect pattern 50*b* from the distance X1 between the two lines 51*a*, 52*a* in the first inclination detect pattern 50*a*, the position-shift components due to the inclination of the nozzle row 20 can be offset or canceled. That is, the following formula is established:

$$p=|X1-X2|/2$$

Accordingly, the position-shift component p due to the gap difference between the first nozzle group 41 and the second nozzle group 42 can be extracted.

Figure 6:
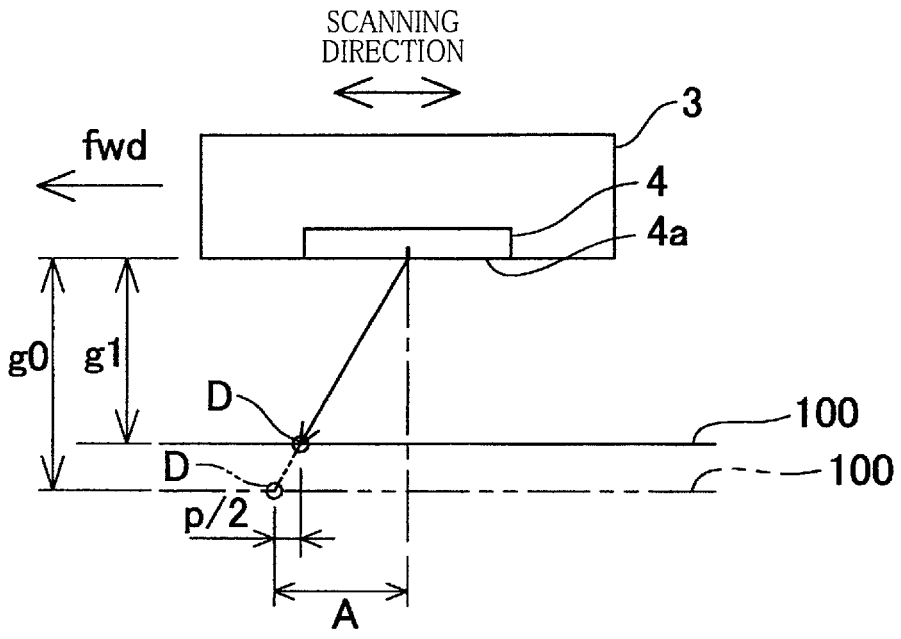
FIG. 6 is a view for explaining calculation of a gap.

The gaps g1, g2 relating to the respective nozzle groups 41, 42 can be obtained as follows on the basis of the position-shift component p. FIG. 6 is a view for explaining how to calculate the gaps. FIG. 6 shows a state in which the droplet is ejected from the first nozzle group 41 that is opposed to the recording sheet 100 with the gap g1 interposed therebetween when the ink-jet head 4 is moving in the forward direction. In FIG. 6, if the gap relating to the first nozzle group 41 is equal to the reference value g0, the droplet D ejected from the nozzle 16 of the first nozzle group 41 attaches to a position which is shifted from a position right below the nozzle by a distance A in the forward direction since the droplet D contains a forward-direction velocity component. The distance A can be easily obtained by multiplying the moving speed of the carriage 3 with a flight time required for the droplet D to attach to the recording medium 100. Here, the flight time is obtained from the droplet speed obtained in advance and the reference value g0 of the gap. On the other hand, if the gap relating to the first nozzle group 41 is equal to g1, the attaching position of the droplet D is shifted by a distance corresponding to a half of the position-shift component p extracted as described above, i.e., p/2. In FIG. 6, since g0, A, and p/2 are known, the gap g1 can be obtained from similitude relations between two triangles. For the second nozzle group 42, the gap g2 can be similarly obtained. Hence, the gap difference |g1−g2| is obtained.

Subsequently, the gap adjustment is carried out by adjusting the inclination of the platen 2 or the height positions of the two conveyance rollers 18, 19, for instance, such that the gap difference is eliminated. As in the adjustment of the inclination of the head 4 described above, the gap adjustment may be carried out in accordance with the position-shift component p due to the gap difference, without obtaining the gap difference per se.

In the present embodiment illustrated above, the first inclination detect pattern 50*a* is formed on the recording sheet 100 by moving the ink-jet head 4 in one of the opposite two directions in the scanning direction, and the second inclination detect pattern 50*b* is formed by moving the head 4 in the other of the opposite two directions in the scanning direction. By utilizing the thus formed two inclination detect patterns 50*a*, 50*b*, the position-shift components p in the respective two inclination patterns 50*a*, 50*b*, each of which is contained in the distance between the two lines 51, 52 and is caused by the gap difference between the two nozzle groups 41, 42, are offset or cancelled, whereby the position-shift component L sin θ due to the inclination of the nozzle row 20 can be extracted. Accordingly, the inclination angle θ of the nozzle row 20 can be accurately detected. On the contrary, the position-shift components L sin θ in the respective first and second inclination detect patterns due to the inclination of the nozzle row 20 are offset or canceled, whereby the position-shift component p due to the gap difference between the first nozzle group 41 and the second nozzle group 42 can be extracted. Accordingly, the gap difference can be accurately detected.

Further, in each of the first-pattern forming step and the second-pattern forming step, the recording sheet 100 is conveyed in the conveyance direction in a time period between the formation of the line 51 by the first nozzle group 41 (FIG. 3A) and the formation of the line 52 by the second nozzle group 42 (FIG. 3B), so that the positions of the respective two lines 51, 52 in the conveyance direction can be made close to each other. In particular, by setting the conveyance amount of the recording sheet 100 to the distance L between the two nozzle groups 41, 42, the positions of the respective two lines 51, 52 in the conveyance direction can be completely conformed to each other. Further, by controlling the droplet ejection timings of the respective two nozzle groups 41, 42 such that the positions of the respective two lines 51, 52 in the scanning direction coincide with each other so as to permit the two lines 51, 52 would overlap each other, it is possible to considerably easily detect the position shift of the two lines 51, 52 in the scanning direction due to the inclination of the nozzle row 20 or the gap difference between the two nozzle groups 41, 42.

Next, there will be explained some modified embodiments of the invention. In the following modified embodiments, the same reference numerals as used in the illustrated embodiment are used to identify the corresponding components and a detailed explanation thereof is dispensed with.

Modified Embodiment 1

In the illustrated embodiment, the droplet ejection timings of the respective two nozzle groups 41, 42 are controlled such that the two lines 51, 52 in the inclination detect pattern 50 would overlap each other, in a state in which no inclination of the nozzle row 20 exists and no gap difference between the two nozzle groups 41, 42 exist. The droplet ejection timings may be controlled such that the two lines 51, 52 are spaced apart from each other in the scanning direction by a prescribed distance X0. In this case, as in the illustrated embodiment, the distances X1, X2 are first obtained, the distance X0 is subsequently subtracted from the sum of the distances X1, X2, and the inclination the nozzle row 20 is finally obtained.

Modified Embodiment 2

Figure 7:
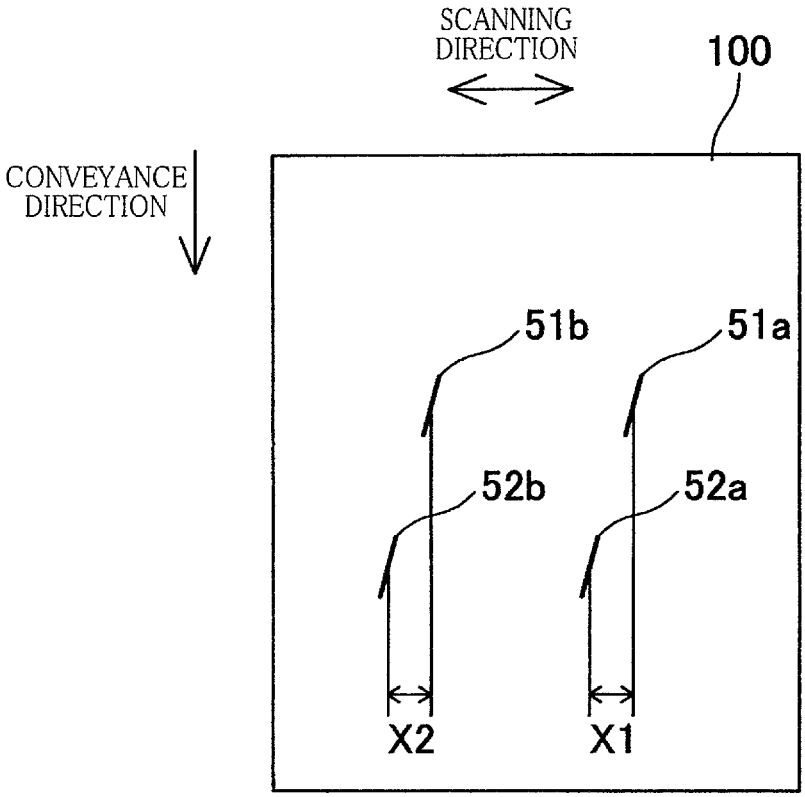
FIG. 7 is a view showing inclination detect patterns in one modified embodiment.

As shown in FIG. 7, even where the positions of the two lines 51*a*, 52*a*; 51*b*, 52*b* of the inclination detect pattern 50*a*; 50*b* are distant from each other in the conveyance direction, it is possible to detect the distance X1; X2 between the two lines 51, 52 in the scanning direction. Accordingly, the two lines 51, 52 can be formed concurrently in one scanning of the ink-jet head 42, without conveying the recording sheet 100 in a time period between the formation of the line 51 and the formation of the line 52.

Modified Embodiment 3

The ink-jet printer 1 may be configured not only to form the inclination detect patterns on the recording sheet 100, but also to detect the inclination of the nozzle row 20 from the inclination detect patterns as described below.

Figure 8:
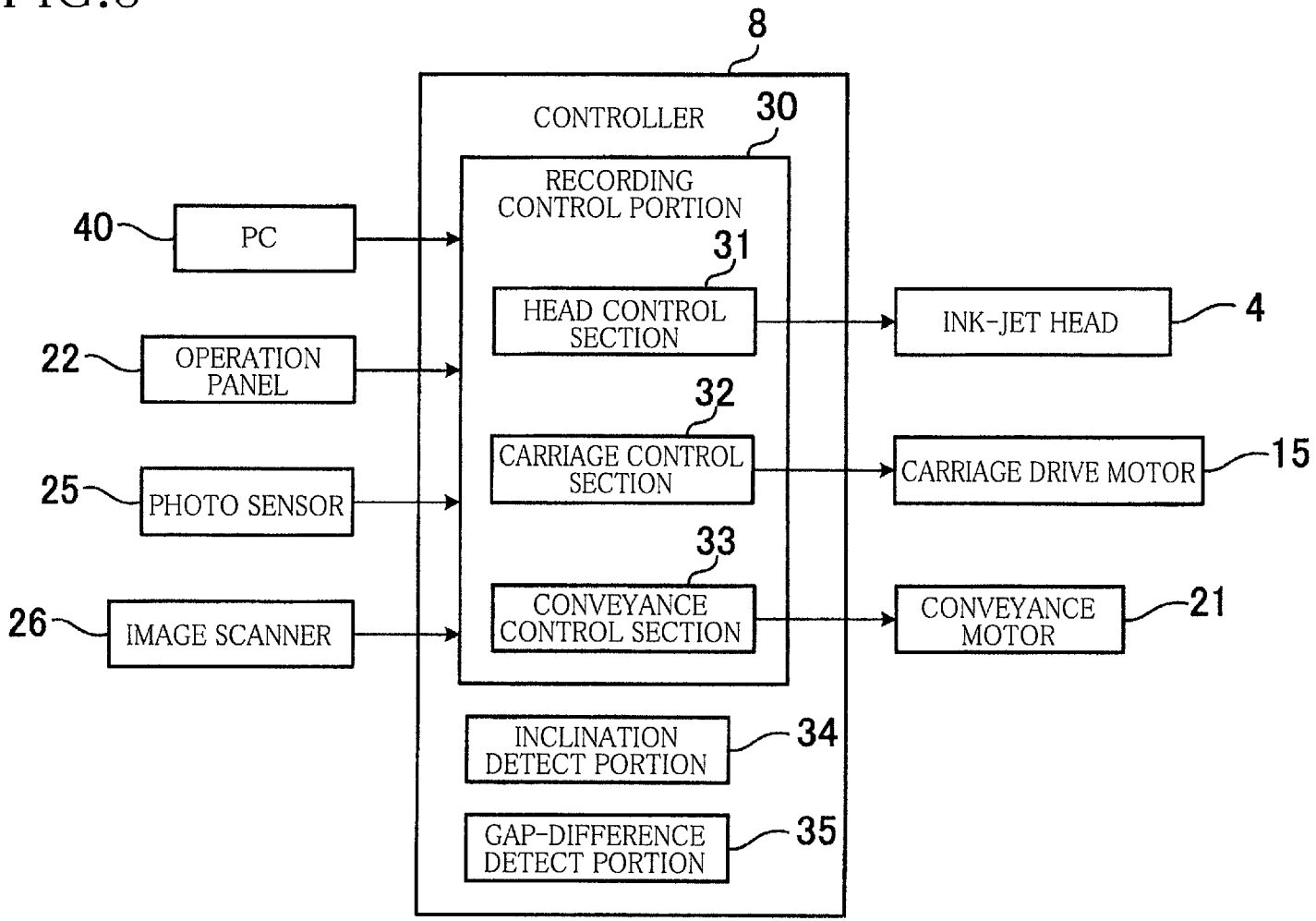
FIG. 8 is a block diagram of an ink-jet printer according to another modified embodiment.

Referring to the block diagram of FIG. 8, there will be explained a modified embodiment 3 in which the ink-jet printer 1 is equipped with an image scanner 26 configured to read the inclination detect patterns 50*a*, 50*b* formed on the recording sheet 100, namely, the ink-jet printer 1 is the so-called composite machine. Further, the controller 8 includes an inclination detect portion 34 configured to detect the distance between the two lines 51, 52 from image data of each inclination detect pattern read by the image scanner 26 and to detect the inclination of the nozzle row 20. More specifically, the inclination detect portion 34 is configured to detect the inclination of the nozzle row 20 on the basis of a sum of the distance X1 between the two lines 51*a*, 52*a* in the first inclination detect pattern 50*a* and the distance X2 between the two lines 51*b*, 52*b* in the second inclination detect pattern 50*b*. Where the inclination of the nozzle row 20 is detected on the side of the printer 1, it is possible to subsequently adjust the droplet ejection timings of the nozzles 16 that constitute the nozzle row 20 in accordance with the inclination of the nozzle row 20. The controller 8 may further include a gap-difference detect portion 35 configured to detect the gap difference between the two nozzle groups 41, 42 on the basis of a difference between the distance X1 and the distance X2.

Modified Embodiment 4

Figure 9:
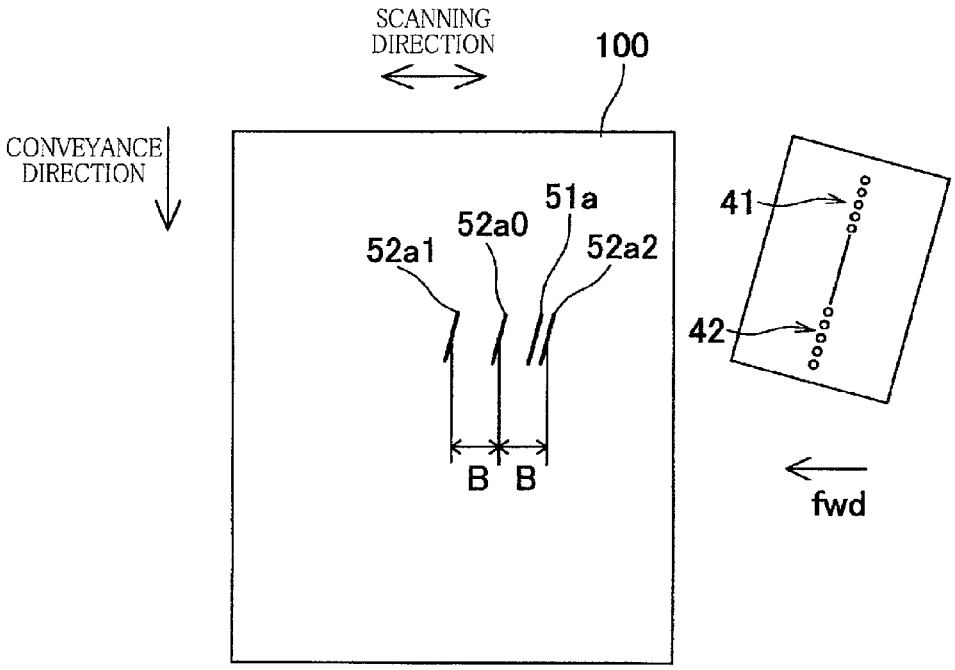
FIG. 9 is a view showing an inclination detect pattern in still another modified embodiment.

One line may be formed by one of the first nozzle group 41 and the second nozzle group 42 while a plurality of lines may be formed by the other of the first nozzle group 41 and the second nozzle group 42 so as to be located at mutually different positions in the scanning direction. In FIG. 9, one line 51*a* is formed by the first nozzle group 41 while three lines 52*a*0, 52*a*1, 52*a*2 are formed by the second nozzle group 42 so as to be equally spaced apart from each other. Here, the central line 52*a*0 is a line (a reference line) which overlaps the one line 51*a* formed by the first nozzle group 41 in a normal state in which there exist no inclination of the nozzle row 20 and no gap difference between the two nozzle groups 41, 42.

In this instance, a distance B between adjacent two of the three lines 52*a*0, 52*a*1, 52*a*2 formed by the second nozzle group 42 is already known from the droplet ejection timing (the positions of the head 4 in the scanning direction) when the three lines are formed. Accordingly, by regarding that one of the three lines 52*a*0, 52*a*1, 52*a*2 (the rightmost line 52*a*2 in FIG. 9) formed by the second nozzle group 42, which is the closest to the one line 51*a* formed by the first nozzle group 41*d*, overlaps the one line 51*a*, the distance between the one line 51*a* and the reference line 52*a*0 in the scanning direction is regarded to be equal to the distance B, whereby the distance between the one line 51*a* and the reference line 52*a*0 in the scanning direction can be easily obtained. Thus, the inclination of the nozzle row 20 can be easily detected.

This modified embodiment 4 is suitable in an instance in which the user of the printer 1 checks each inclination detect pattern formed by the printer 1 and detects the distance between the two lines 51, 52 in each inclination detect pattern. That is, when the user visually checks the inclination detect pattern, it is difficult to accurately detect the distance between the two lines 51, 52 in FIG. 3 or 4. Accordingly, if the user selects, from the inclination detect pattern of FIG. 9, the closest line (the rightmost line 52*a*2 in FIG. 9) that is the closest to the one line 51*a* formed by the first nozzle group 41 among the three lines 52*a*0, 52*a*1, 52*a*2 formed by the second nozzle group 42, the checking of the inclination detect pattern is easy. Subsequently, the line selected by the user may be inputted through an input portion such as the operation panel 22 (FIG. 8) of the printer 1, whereby the inclination detect portion 34 of the printer 1 can easily detect the inclination of the nozzle row 20. In the arrangement, the user visually judges the closest line that is the closest to the one line 51*a* among the three lines 52*a*0, 52*a*1, 52*a*2 and the selected line is inputted through the operation panel 11. The arrangement may be modified such that the image scanner 26 reads the recording sheet on which the three lines 52*a*0, 52*a*1, 52*a*2 and such that the closest line that is the closest to the one line 51*a* is selected.

Modified Embodiment 5

In the illustrated embodiment, the gap difference between the two positions (corresponding to the two nozzle groups 41, 42) in one nozzle row 20 is obtained. The surface of the recording sheet 100 is not always flat, but is sometimes warped. For instance, where the upper surface of the platen 2 on which the recording sheet 100 is placed is located slightly higher or slightly lower than the plane including the two conveyance rollers 18, 19, the central portion of the recording sheet 100 in the conveyance direction slightly protrudes or is slightly concaved. In this instance, it is preferable to detect the gap difference at each of at least three positions of the nozzle row 20.

Figure 10:
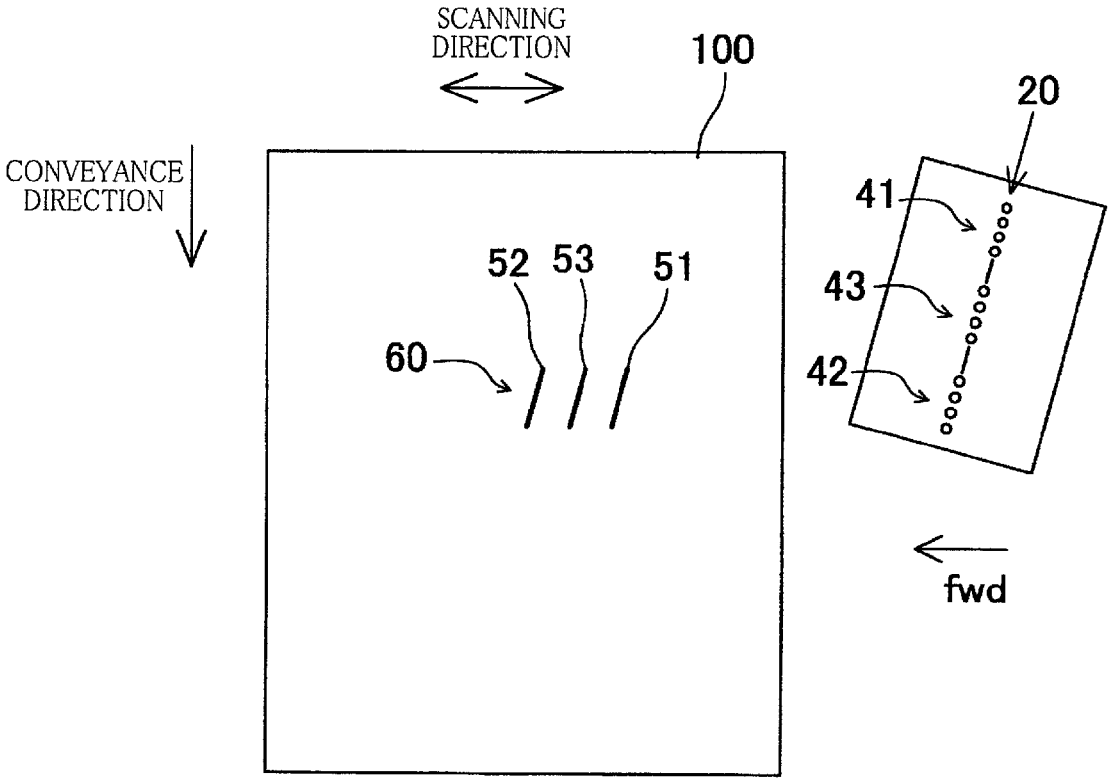
FIG. 10 is a view showing an inclination detect pattern in yet another modified embodiment.

In view of the above, an inclination detect pattern 60 composed of three lines 51, 52, 53 may be formed using, in addition to the first nozzle group 41 and the second nozzle group 42, a third nozzle group 43 located therebetween, as shown in FIG. 10. This modified embodiment 5 enables detection of the gap differences among the three nozzle groups 41, 42, 43. By increasing the number of positions in one nozzle row 20 at which the gap difference is detected, the detection accuracy is enhanced. It is noted that the inclination detect pattern may be formed using four or more nozzle groups.

Modified Embodiment 6

In the illustrated embodiment, on the precondition that the plurality of nozzles 16 are arranged along the conveyance direction, the inclination of the nozzle row 20 relative to the conveyance direction as the normal nozzle arrangement direction is detected. The normal arrangement direction of the nozzles 16 per se may intersect the conveyance direction relative to at an angle less than 90 degrees relative to the conveyance direction.

Modified Embodiment 7

In the illustrated embodiment, the recording sheet 100 is conveyed by the conveyor mechanism 5 in the conveyance direction. The ink-jet head 4 may be configured to move not only in the scanning direction, but also in a direction intersecting the scanning direction, namely, in the conveyance direction, whereby the ink-jet head 4 is moved relative to the recording sheet 100, so as to establish relative conveyance between the recording sheet 100 and the ink-jet head 4.

What is claimed is:

1. An ink-jet recording apparatus, comprising:

an ink-jet head having a droplet ejecting surface in which a plurality of nozzles from which droplets of ink are ejected are formed in at least one row along a prescribed nozzle arrangement direction, the ink-jet head being movable in a scanning direction parallel to the droplet ejecting surface and intersecting the prescribed nozzle arrangement direction;

a conveyor mechanism configured to move, in a conveyance direction parallel to the droplet ejecting surface and intersecting the scanning direction, at least one of the ink-jet head and a recording medium that is disposed so as to be opposed to the droplet ejecting surface, such that the ink-jet head and the recording medium are moved relative to each other; and a controller configured to control the ink-jet recording apparatus, wherein the controller includes a pattern forming portion configured to form, on the recording medium, an inclination detect pattern for detecting inclination of the at least one nozzle row with respect to the prescribed nozzle arrangement direction due to rotational displacement of the ink-jet head in a plane parallel to the droplet ejecting surface, by controlling the ink-jet head and the conveyor mechanism, and wherein the pattern forming portion is configured to form, as the inclination detect pattern, (A) a first inclination detect pattern including mutually parallel two lines formed by permitting the droplets to be ejected respectively from: a first nozzle group composed of the nozzles that constitute a first section of one of the at least one nozzle row; and a second nozzle group composed of the nozzles that constitute a second section of the one of the at least one nozzle row different from the first section, when the ink-jet head moves in a first direction as one of opposite two directions in the scanning direction, and (B) a second inclination detect pattern including mutually parallel two lines formed by permitting the droplets to be ejected respectively from: the first nozzle group; and the second nozzle group, when the ink-jet head moves in a second direction as the other of the opposite two directions in the scanning direction, wherein the controller further includes an inclination detect portion configured to detect the inclination of the at least one nozzle row on the basis of a recognition result of the first inclination detect pattern and the second inclination detect pattern formed on the recording medium, and wherein the inclination detect portion is configured to obtain a distance in the scanning direction between the two lines in the first inclination detect pattern and a distance in the scanning direction between the two lines in the second inclination detect pattern and to detect the inclination of the at least one nozzle row on the basis of a sum of the distances.

2. The ink-jet recording apparatus according to claim 1, wherein the pattern forming portion is configured to form the first inclination detect pattern and the second inclination detect pattern such that at least one of the recording medium and the ink-jet head is moved by the conveyor mechanism in the conveyance direction in a time period between ejection of the droplets from one of the first nozzle group and the second nozzle group and ejection of the droplets from the other of the first nozzle group and the second nozzle group, in each of formation of the first inclination detect pattern and formation of the second inclination detect pattern.

3. The ink-jet recording apparatus according to claim 2, wherein the pattern forming portion is configured to permit the droplets to be ejected from each of the first nozzle group and the second nozzle group at a timing in which one of the two lines formed by the first nozzle group and the other of the two lines formed by the second nozzle group would overlap each other, in each of the formation of the first inclination detect pattern and the formation of the second inclination detect pattern.

4. The ink-jet recording apparatus according to claim 3, wherein the pattern forming portion is configured to form the first inclination detect pattern and the second inclination detect pattern each of which includes (a) one line as the one of the two lines formed by the one of the first nozzle group and the second nozzle group and (b) a plurality of lines each of which is the other of the two lines formed by the other of the first nozzle group and the second nozzle group and which are mutually different in position in the scanning direction, and wherein the pattern forming portion is configured to permit the droplets to be ejected from the second nozzle group at a timing in which one of the plurality of lines functions as a reference line that would overlap the one line in an instance in which no inclination of the at least one nozzle low with respect to the prescribed nozzle arrangement direction exists and no gap difference exists, the gap difference being a difference between: a distance between the droplet ejecting surface and the recording medium at a position where the first nozzle group is disposed; and a distance between the droplet ejecting surface and the recording medium at a position where the second nozzle group is disposed.

5. The ink-jet recording apparatus according to claim 4, wherein the controller further includes an inclination detect portion configured to detect the inclination of the at least one nozzle row on the basis of a recognition result of the first inclination detect pattern and the second inclination detect pattern formed on the recording medium, and wherein the inclination detect portion is configured to (i) regard that the one line formed by the one of the first nozzle group and the second nozzle group overlaps one of the plurality of lines which is formed by the other of the first nozzle group and the second nozzle group and which is the closest to the one line in the scanning direction and (ii) obtain a distance between the one line and the reference line in the scanning direction on the basis of a position of the ink-jet head at a time point when the closest line is formed, for each of the first inclination detect pattern and the second inclination detect pattern, and wherein the inclination detect portion is configured to detect the inclination of the at least one nozzle row on the basis of the distance in the first inclination detect pattern and the distance in the second inclination detect pattern.

6. The ink-jet recording apparatus according to claim 1, wherein the controller further includes a gap-difference detect portion configured to detect a gap difference which is a difference between: a distance between the droplet ejecting surface and the recording medium at a position where the first nozzle group is disposed; and a distance between the droplet ejecting surface and the recording medium at a position where the second nozzle group is disposed, on the basis of the recognition result of the first inclination detect pattern and the second inclination detect pattern formed on the recording medium, and wherein the gap-difference detect portion is configured to detect the gap difference on the basis of a difference between: the distance in the scanning direction between the two lines in the first inclination detect pattern; and the distance in the scanning direction between the two lines in the second inclination detect pattern.

7. A method of detecting inclination of a nozzle row of an ink-jet head of an ink-jet recording apparatus, wherein the ink-jet recording apparatus includes:

the ink-jet head having a droplet ejecting surface in which a plurality of nozzles from which droplets of ink are ejected are formed in at least one row along a prescribed nozzle arrangement direction, the ink-jet head being movable in a scanning direction parallel to the droplet ejecting surface and intersecting the prescribed the nozzle arrangement direction; and a conveyor mechanism configured to move, in a conveyance direction parallel to the droplet ejecting surface and intersecting the scanning direction, at least one of the ink-jet head and a recording medium that is disposed so as to be opposed to the droplet ejecting surface, such that the ink-jet head and the recording medium are moved relative to each other;

wherein the method is for detecting inclination of the at least one nozzle row with respect to the prescribed nozzle arrangement direction due to rotational displacement of the ink-jet head in a plane parallel to the droplet ejecting surface and comprise:

a pattern forming step of forming on the recording medium (A) a first inclination detect pattern including mutually parallel two lines by permitting the droplets to be ejected respectively from: a first nozzle group formed of the nozzles that constitute a first section of one of the at least one nozzle row; and a second nozzle group formed of the nozzles that constitute a second section of the one of the at least one nozzle row different from the first section, when the ink-jet head moves in a first direction as one of opposite two directions in the scanning direction and (B) a second inclination detect pattern including mutually parallel two lines by permitting the droplets to be ejected respectively from: the first nozzle group; and the second nozzle group, when the ink-jet head moves in a second direction as the other of the opposite two directions in the scanning direction, and an inclination detecting step including: obtaining a distance in the scanning direction between the two lines in the first inclination detect pattern formed on the recording medium and a distance in the scanning direction between the two lines in the second inclination detect pattern formed on the recording medium; and detecting the inclination of the at least one nozzle row detected on the basis of a sum of the distances.

8. The method according to claim 7, further comprising a gap-difference detecting step of detecting a gap difference which is a difference between: a distance between the droplet ejecting surface and the recording medium at a position where the first nozzle group is disposed; and a distance between the droplet ejecting surface and the recording medium at a position where the second nozzle group is disposed, on the basis of a difference: between the distance in the scanning direction between the two lines in the first inclination detect pattern formed on the recording medium and the distance in the scanning direction between the two lines in the second inclination detect pattern formed on the recording medium.

9. An ink-jet recording apparatus, comprising:

an ink-jet head having a droplet ejecting surface in which a plurality of nozzles from which droplets of ink are ejected are formed in at least one row along a prescribed nozzle arrangement direction, the ink-jet head being movable in a scanning direction parallel to the droplet ejecting surface and intersecting the prescribed nozzle arrangement direction;

a conveyor mechanism configured to move, in a conveyance direction parallel to the droplet ejecting surface and intersecting the scanning direction, at least one of the ink-jet head and a recording medium that is disposed so as to be opposed to the droplet ejecting surface, such that the ink-jet head and the recording medium are moved relative to each other; and a controller configured to control the ink-jet recording apparatus, wherein the controller includes a pattern forming portion configured to form, on the recording medium, an inclination detect pattern for detecting inclination of the at least one nozzle row with respect to the prescribed nozzle arrangement direction due to rotational displacement of the ink-jet head in a plane parallel to the droplet ejecting surface, by controlling the ink-jet head and the conveyor mechanism, and wherein the pattern forming portion is configured to form, as the inclination detect pattern, (A) a first inclination detect pattern including mutually parallel two lines formed by permitting the droplets to be ejected respectively from: a first nozzle group composed of the nozzles that constitute a first section of one of the at least one nozzle row; and a second nozzle group composed of the nozzles that constitute a second section of the one of the at least one nozzle row different from the first section, when the ink-jet head moves in a first direction as one of opposite two directions in the scanning direction, and (B) a second inclination detect pattern including mutually parallel two lines formed by permitting the droplets to be ejected respectively from: the first nozzle group; and the second nozzle group, when the ink-jet head moves in a second direction as the other of the opposite two directions in the scanning direction, wherein the pattern forming portion is configured to form the first inclination detect pattern and the second inclination detect pattern such that at least one of the recording medium and the ink-jet head is moved by the conveyor mechanism in the conveyance direction in a time period between ejection of the droplets from one of the first nozzle group and the second nozzle group and ejection of the droplets from the other of the first nozzle group and the second nozzle group, in each of formation of the first inclination detect pattern and formation of the second inclination detect pattern.

* * * * *